United States Patent [19]

Glucksman

[11] Patent Number: 4,548,218

[45] **Date of Patent: * Oct. 22, 1985**

[54] HAIR CURLING ROLLER

[76] Inventor: Dov Z. Glucksman, 26 Beacon St., Apt. 9F, Burlington, Mass. 01803

[ * ] Notice: The portion of the term of this patent subsequent to May 10, 2000 has been disclaimed.

[21] Appl. No.: 567,238

[22] Filed: Dec. 30, 1983

[51] Int. Cl.[4] ..... A45D 2/02

[52] U.S. Cl. ..... 132/39; 132/33 R

[58] Field of Search ..... 132/39, 33 R, 33 G, 132/40, 42, 9

[56] References Cited

U.S. PATENT DOCUMENTS

| | | | |
|---|---|---|---|
| Re. 26,766 | 1/1970 | Jorgensen | 219/222 |
| 3,208,459 | 9/1965 | Kramer | 132/40 |
| 3,209,766 | 10/1965 | Dannat | 132/40 |
| 3,267,942 | 8/1966 | Mestral | 132/40 |
| 3,538,925 | 11/1970 | Reiner | 132/39 |
| 3,584,632 | 6/1971 | Weidner | 132/9 |
| 3,600,552 | 8/1971 | Tolmie | 219/222 |
| 3,696,819 | 10/1972 | Jensen | 132/33 R |
| 4,382,447 | 5/1983 | Glucksman | 132/33 R |

*Primary Examiner*—Gregory E. McNeil

*Attorney, Agent, or Firm*—John S. Roberts, Jr.

[57] ABSTRACT

A hair curler roller having a top and bottom end adapted to be heated while its bottom end is seated on one of a plurality of identical frusto-conical, heated posts of a heating unit. The roller consists of a cylindrical shell of a material of low heat conductivity, such as a synthetic resin, provided on its outside with hair-gripping means, and of a sleeve of a material of high conductivity, such as aluminum, inserted into the shell in intimate contact therewith. The top of the roller is preferably closed by suitable cover or cap of a synthetic resin, while the shell and the sleeve are open at their bottom. The sleeve comprises an upper cylindrical main portion closely adhering to the inside of the shell, and a lower, short neck portion of a smaller diameter, spaced apart from the shell wall. The neck portion is slotted by a plurality of slots permitting the outward expansion of the neck portion conforming to the shape of the frusto-conical post on which it is positioned.

20 Claims, 7 Drawing Figures

HAIR CURLING ROLLER

BACKGROUND OF THE INVENTION

The invention relates to a hair curling roller comprising an outer plastic shell and a metal sleeve inserted therein, adapted to be heated before being placed into the hair, by being positioned on a frusto-conical post of a roller heating set.

Hair rollers are substantially cylindrical in shape and are being used by wrapping strands of hair around their periphery to shape the hair in curls or waves, with the curl or wave diameter corresponding to the outer diameter of the roller.

In order to acheive a curl that will last a reasonable length of time the hair strands should be heated while they are wrapped around the roller and should not be removed from the roller until they have cooled down.

An important point in connection with hair curling and setting is the requirement of rollers of different size with a view to obtaining the desired form and shape of the hairdo. For this purpose cylindrical rollers of three different diameters are currently on the market which are known in the trade as "small", "medium" and "large". They are conventionally heated in an electric hair roller heating set which contains three different sizes of cylindrical heating posts on which the rollers are seated and heated to the required temperature which is regulated by a thermostatic switch. It is evident that this arrangement defines the number of rollers of each size, which may not always be palatable with the user's needs; however this problem cannot be solved with the existing heating sets and hair rollers.

It is, therefore, the foremost object of the invention to provide hair rollers in at least three sizes which can be heated by being positioned in a heating set provided with a plurality of posts all of identical diameter, thus permitting individual selection of rollers according to their diameter for each type of hair setting to be used with one and the same heating set.

SUMMARY OF THE INVENTION

The roller of the present invention which is suitable for being heated on a frusto-conical post of a heating unit, consists of a cylindrical shell of a material of low heat conductivity, such as a synthetic resin, provided on its outside with hair-gripping means; and of a sleeve of a material of high conductivity, e.g., aluminum, inserted into the shell in intimate contact therewith. The top of the roller is preferably closed by a suitable cover or cap of a synthetic resin, while the shell and the sleeve are open at their bottom. The sleeve comprises an upper cylindrical main portion closely adhering to the inside of the shell, and a lower, short neck portion of smaller diameter, spaced-apart from the shell wall. The neck portion is slotted by a plurality of slots permitting the outward expansion of the neck portion conforming to the shape of the frusto-conical post on which it is positioned. The slots are preferably parallel to the sleeve axis starting from the bottom end and terminating above the upper end of the neck portion. Their width is determined in a manner permitting the remaining rectangular sections between each two slots to be joined and to form the circumference of the neck portion.

The hair-gripping means, as known to the art, may consist of a plurality of outwardly projecting teeth, of a multitude of loops of a woven material or of fine fibers projecting out of the surface of the shell. With a view to providing three or more sizes of rollers, the shell and the upper portion of the sleeve in each size roller are made to be of different diameter, e.g., "small", "medium", and "large", while the neck portion in inwardly stepped to an identical diameter in respect of all sizes. This permits the positioning of any size roller onto any of the frusto-conical posts of a heating set which is provided with only one size of posts, thereby allowing the user to choose any kind of variation of roller sizes, so as to suit the desired form of hairdo in every case.

In order to obtain indirect and better heat transfer from the sleeve to the hair the shell may be perforated so as to form a cage consisting of several circular hoops in spaced apart parallel alignment and of several rows of stays connecting adjoining hoops, thus defining rectangular, arcuate openings between hoops and stays, the cage terminating at its both ends in cylindrical, non-perforated portions.

In a preferred embodiment of the roller the sleeve is slit length-wise and is, prior to its being inserted into the shell, of a somewhat larger outside diameter than the inner diameter of the shell; this feature permits its insertion into the shell in contracted state, and its subsequent expansion towards the inner surface of the shell, thus providing intimate contact.

There are provided various means serving to secure the sleeve in lengthwise direction: a preferred means consists in an inwardly extending collar provided in the lower portion of the shell and abutting on the bottom end of the upper cylindrical portion of the sleeve. A second means consists in inwardly projecting, lengthwise extending ribs, abutting on the bottom end of the upper cylindrical portion. A third means serving to secure the sleeve both in length-wise as well as in radial direction consists in at least one lug projecting from the inner surface of the cage and mating with at least one corresponding recess or perforation in the sleeve.

With a view to securing the sleeve in the shell against rotation the shell is advantageously provided with a longitudinal ridge protruding out of its inner surface, engaging with the longitudinal slot in the sleeve. The sleeve extends preferably from the top of the shell to a short distance from the bottom end of the shell, but it may be shorter in its top portion in all cases where the cap is inserted into the shell in contact with the cage walls.

The cap closing the top of the roller consists of a cover plate and a skirt attached thereto, the outer diameter of the skirt cooperating with the inner diameter of the sleeve at its upper end, the skirt being provided with concave indentations mating with protrusions on the inside of the sleeve.

In order to prevent crooked positioning of the roller on the heated post the bottom end of the shell may be provided with an inner collar of a diameter slightly larger than that of the post. With the same object in view a third collar is provided on the cage inside in a location corresponding to the bottom end of the neck portion of an inner diameter slightly larger than the outer diameter of this portion at its bottom end. The aforementioned features and additional details will become apparent from the following description of the preferred embodiment taken in conjunction with the accompanying drawings.

Figure 3:
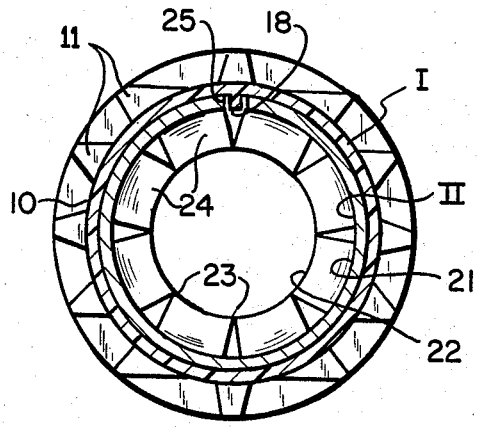
FIG. 3 is a cross section of the roller along the line A—A of FIG. 2.
Figure 4:
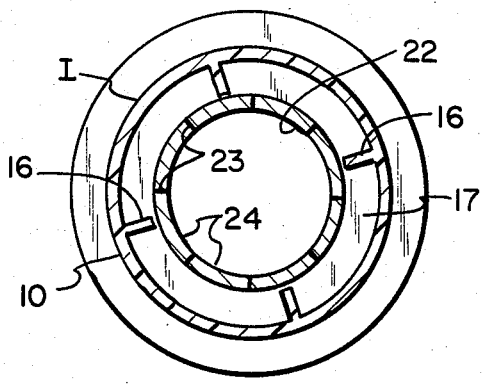
FIG. 4 is a cross section of the roller along the line B—B of FIG. 2.
Figure 5:
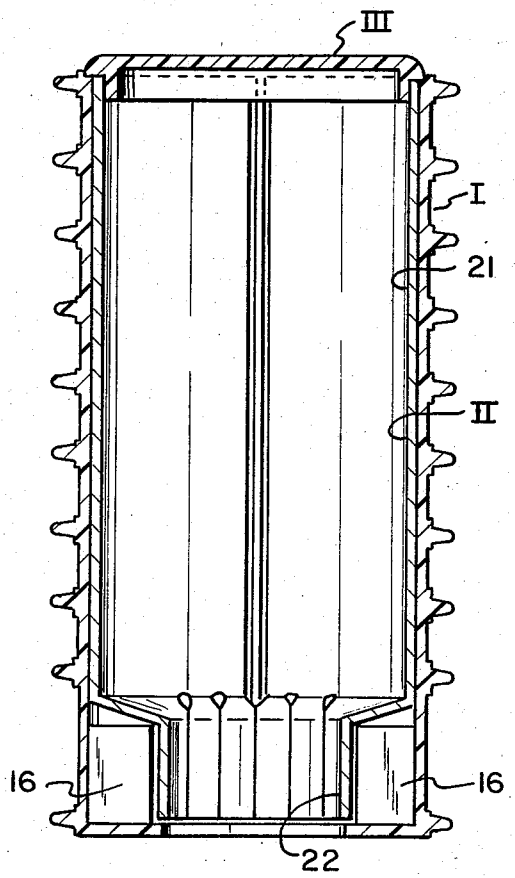
FIG. 5 is a longitudinal section through a hair curling roller of "large" diameter.

The roller illustrated in FIGS. 1 through 4 is a "small-size" roller, while that of FIG. 5 is a "large-size" roller, a "medium-size" roller, having a diameter inbetween the two. The length of the rollers shown in the drawings is identical of all sizes, but there is no reason why a "large-size" roller may not be of greater length than a "small-size" roller, or vice versa.

Referring now to FIGS. 1 through 4 of the drawings, a small-size roller consists of a shell I, a stepped sleeve II, and a cap III. The shell is in the shape of a straight cylinder 10 and of outwardly extending teeth 11 which can be clearly seen in FIG. 1. Several longitudinal ribs 16 extend in the lower portion of the shell I in inward direction; they serve to support the stepped sleeve II, and prevent its length-wise movement in the shell. An inwardly extending collar 17 surrounds the lower end of the cylinder 10 of the shell, and a key or ridge 18 extends along the upper portion of the inside of the cylinder 10 of the shell.

The sleeve II comprises a smooth, cylindrical main portion 21 extending from the top of the cylinder 10 of the shell to a point above and close to the ribs 16, from where it is stepped down to a cylindrical neck portion 22 of smaller diameter. The neck portion is slotted by several longitudinal slots 23 forming a like number of elastic arcuate blades 24 between these slots. The blades 24 form the circumference of the cylindrical neck portion 22 and are adapted to expand whenever the roller is seated on a frusto-conical post of a heater and thus closely adhere to this post. The sleeve is slotted along its entire length, resulting in one longitudinal open slot 25 in the main cylindrical portion, which engages with the key or ridge 18 in the shell, thus preventing rotation of the sleeve in the cylinder of the shell.

A plastic cap III covers the top of the roller and is rigidly fastened to the shell cylinder in a manner which makes its removal substantially impossible. The sleeve is formed by rolling or forming a rectangular sheet of metal, e.g., aluminum, of predetermined dimensions. Before deformation a number of slots 23 are cut into one side of the sheet, whereby the total width of all slots is equal to the circumference of the main cylinder 21 minus the circumference of the neck portion. After the rolling or forming operation the diameter of the slotted cylinder (21) is left to be larger than the inner diameter of the shell, in order to permit its elastic expansion after its insertion into the cylinder. However, before its insertion, the neck portion 22 is formed by pressing it in a suitable die, or other-wise, whereby the edges of the slots 23 are approached to each other, thus obtaining a virtually closed cylinder. In order to insert the sleeve into the shell, it is contracted to the inner shell diameter in a known manner and pushed into the shell cylinder until it is stopped by the ribs 16 provided in the lower portion on the inside of the shell cylinder. The sleeve is released, after its insertion, and allowed to expand while aligned in such a manner that the key or ridge 18 of the shell coincides with the slot 25 in the sleeve.

FIG. 5 is a section through a "large-size" roller, having a shell I of larger diameter and, accordingly, the main cylindrical portion 21 of the sleeve II of a corresponding large diameter, while the diameter of the neck portion 22 is identical with the diameter of that of the "small-size" roller. The dimensions of the cap III and of the ribs 16 are altered in relation to the larger diameter, while the number of teeth is larger than with the small-size roller with the object of retaining the same distance between adjoining teeth.

Figure 1:
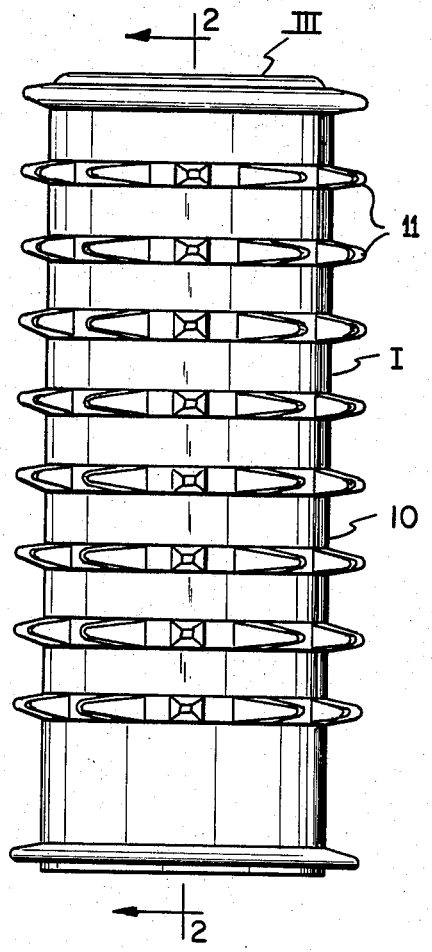
FIG. 1 is an elevation of a hair curling roller.
Figure 2:
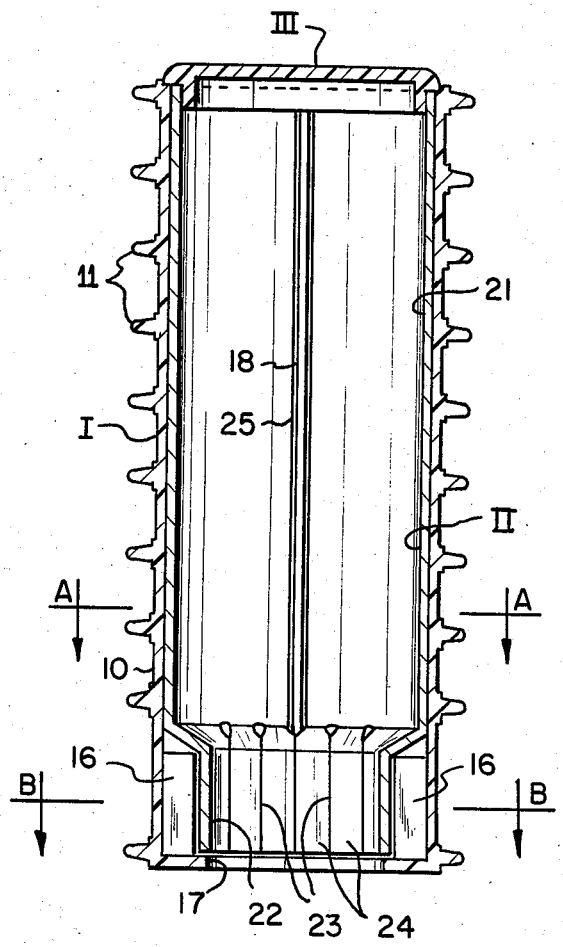
FIG. 2 is a longitudinal section through a hair curling roller of "small" diameter.
Figure 6:
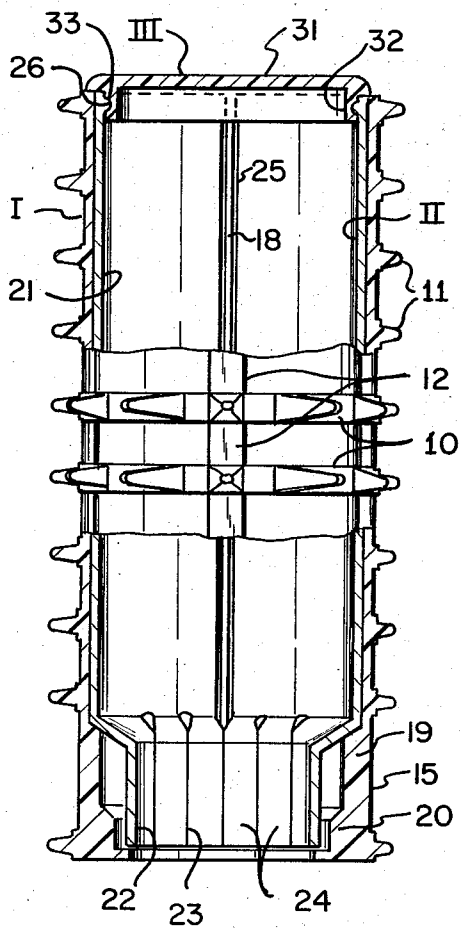
FIG. 6 is a longitudinal section through a roller of "small" diameter, provided with a perforated shell in the shape of a cage consisting of parallel hoops and connecting stays.

The hair roller of FIG. 6 is in most parts identical with that illustrated in FIGS. 2, 3 and 4, and identical numerals are being utilized to indicate identical parts of the two embodiments. The sleeve II itself is substantially the same in both kinds of rollers except for the additional protrusions 26 in the top portion of the sleeve in FIG. 6 which mate with a circumferential groove (33) in the cap II.

The cap III comprises of a flat circular top plate 31 and a cylindrical skirt 32 attached thereto, the outer diameter of the skirt corresponding to the inner diameter of the sleeve II. A circular groove 33 is provided in the outer surface of the skirt 32, which correspond to the position in the sleeve of three or more protrusions 26. The interengaging protrusions and groove serve to keep the cap in position relative to the sleeve, while the latter is secured in the cage by friction only.

In FIG. 6 the shell I differs from that illustrated in FIGS. 1 through 5 in that it is perforated by rectangular, arcuate openings formed between parallel circular hoops 10 and longitudinal stays 12 connecting each two adjoining hoops. The upper and the lower end portions respectively are not perforated but are full cylinders, both the hoops and the end portions being provided with outwardly extending teeth 11, permitting the holding of the hot roller without burning the holder's fingers. An additional characterstic feature of the shell or cage of FIG. 6 is in the replacement of the ribs 16 by a stepped, internal collar 19, 20 on the inside of the cylindrical portion 15. The collar extends from the collar 17 at the bottom end of the cage—which is identical in both embodiments—to the lower end of the upper cylindrical portion of the sleeve II, serving to prevent movement of the sleeve in downward direction, which may be caused by friction with the post during withdrawal of the roller. At its lower end the collar is stepped down to a smaller diameter (20) which is slightly larger than the outer diameter of the neck portion formed by the blades 24. This portion of the collar—as well as the collar 17—will prevent crooked or oblique positioning of the roller onto one of the posts of the heating unit. In all other respects, both as to the construction and their assembly, the two embodiments are identical.

Figure 7:
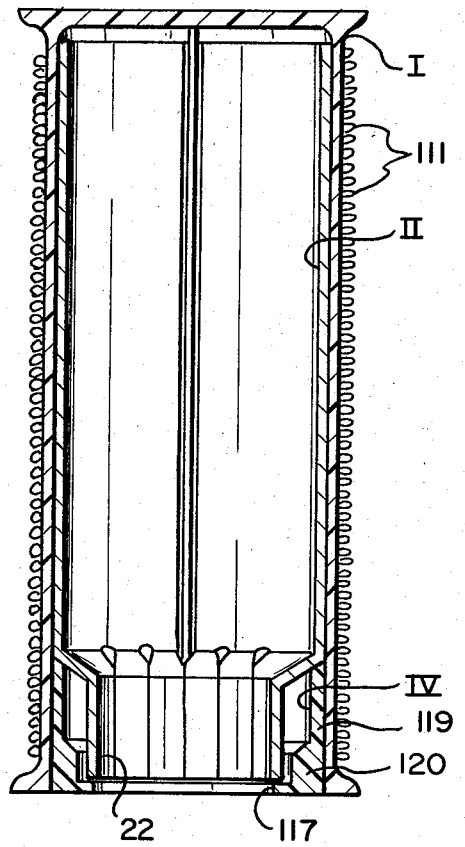
FIG. 7 illustrates still another embodiment of the hair curling roller, wherein the shell is provided with loops of a woven material, and wherein the sleeve securing means consists in a stepped insert.

FIG. 7 illustrates still another embodiment of the shell I, while the sleeve II is substantially identical with that shown in FIG. 6. In this embodiment hair gripping means on the outer surface of the shell are in the shape of small loops 111 of a woven material glued or otherwise fastened to the shell material. The cover III is integral with the cylindrical portion 10 of the shell which latter has a smooth and uniform cylindrical inner surface, without any protrusions. The internal collars 17, 19 and 20 as appearing in FIG. 6, are replaced by a stepped insert IV which is firmly secured in the bottom portion of the shell, extending from the bottom end of the shell to a line coinciding with the bottom end of the cylindrical portion 21 of the sleeve II. The insert IV is stepped to form a thin annulus 119 in its upper portion, a median annulus 120 of an inner diameter slightly larger than the outer diameter of the neck portion 22 of the sleeve, and an inwardly projecting flange 117 forming the bottom end of an inner diameter slightly larger than the outer diameter of the conical post of the heating set on which the roller is to be placed.

The stepped insert permits the insertion of the sleeve into the shell from the bottom end and its securing therein by subsequent pushing the insert into the shell where it is held by any known securing means, one such means consists in protrusions on the outside of the insert mating with indentations on the inside surface of the shell, similar to the indentations 33 and protrusions 26 shown in FIG. 6. It is obvious that this arrangement obviates the provision of a removable cap which is here replaced by an integral cover III closing the top of the shell.

The material of the cage and the cap and/or the stepped insert is a plastic which is sufficiently heat resistant, as for instance polycarbonate, nylon, or polypropylene. The sleeve is made from a sufficiently resilient aluminum alooy sheeting such as, for instance, 1100 alloy H 14, since it is important that the sleeve and the blades of the neck portion retain their elasticity even after numerous heating and cooling cycles.

It will be understood that the foregoing drawings and descriptions represent only three embodiments of the many designs to which the hair curler roller may be constructed, and many variations and modifications may be carried out by a person skilled in the art, though within the spirit of the invention and the scope of the appended claims.

Instead of constructing the cage in the form of parallel hoops and stays, any other configuration may be possible, as long as a maximum of open spaces is available between the construction elements.

The number of slots and their arrangement in the neck portion may be modified by any sort of variation, as long as they permit outward expansion of the neck blades and their return to their original shape. The cover III is not imperative, but it is advantageious in order to prevent heat from being dissipated along the roller onto the atmosphere.

I claim:

1. A hair curler roller having a top and a bottom end, adapted to be heated while its bottom end is seated on one of a plurality of identical frusto-conical, heated posts of a heating unit, said roller constisting of: a cylindrical shell of a substantially cylindrical, smooth inner surface provided on its outside with hair-gripping means; said shell being of a synthetic resin; and of a generally cylindrical sleeve of metal of high heat conductivity positioned inside said shell, said sleeve comprising a top portion of cylindrical configuration closely adhering to the inner surface of said shell, and a neck portion of smaller diameter adapted to fit onto said frusto-conical post of said heating unit, said neck portion being provided with slots arranged in such a manner that said neck portion is free to expand outwardly so as to closely adhere to the surface of said post.

2. The hair curling roller of claim 1 provided in two sizes, where the diameter of the shell of the respective size roller is either "small" or "large", and wherein said top portion of said sleeve corresponds to the inner diameter of said shell, while the diameter of said neck portion is identical for both sizes of roller.

3. The hair curling roller of claim 1 provided in at least three sizes where the diameter of the shell of the respective size roller is either "small", "medium" or "large", and wherein said top portion of said sleeve corresponds to the inner diameter of said shell, while the diameter of said neck portion is identical for every size roller.

4. The hair curling roller of claim 1 wherein said neck portion of said sleeve is slotted by several parallel, longitudinal slots, each two adjacent slots forming an elastic, arcuate blade of material therebetween.

5. The hair curling roller of claim 1, where said hair-gripping means consist of a plurality of outwardly projecting teeth integral with said shell.

6. The hair curling roller of claim 1 wherein said hair-gripping means consists of loops of a woven material secured to the outside surface of said shell.

7. The hair curler roller of claim 1 wherein said shell is provided along its inside with a longitudinal ridge or key.

8. The hair curler roller of claim 7 wherein said top portion of said sleeve is slotted by a longitudinal slot of a width corresponding to the width of said ridge or key, and wherein said slot and said ridge and key cooperate.

9. The hair curling roller of claim 1 wherein said upper cylindrical portion of said sleeve is urged towards the inner surface of said shell by outwardly acting elasticity of said sleeve material.

10. The hair curler roller of claim 1 wherein said shell is closed at its top by a cap of a synthetic resin.

11. The hair curling roller of claim 10 wherein said cap consists of a flat, circular top plate and a cylindrrcal skirt attached thereto, said skirt extending into the top portion of said roller.

12. The hair curling roller of claim 11 wherein said skirt of said cap is of an outer diameter corresponding to the inner diameter of the top portion of said sleeve.

13. The hair curling roller of claim 1 wherein said sleeve extends from the top of said cage to a short distance from the bottom end of said cage.

14. The hair curling roller of claim 2 wherein several ribs project inwardly from said cylindrical bottom portion of said shell stopping short off said neck portion of said sleeve.

15. The hair curling roller of claim 2 wherein said shell is provided in its bottom portion with an internal collar extending from the bottom end to the lower end of the upper, cylindrical portion of said sleeve.

16. The hair curling roller of claim 2 wherein said shell is provided with an internal collar at a height corresponding to the bottom end of said neck portion, said collar being of an inner diameter slightly larger than the outer diameter of said neck portion.

17. The curling roller of claim 2 wherein the bottom end of said shell is provided with an internal collar of an inner diameter slightly larger than the outer diameter of said frusto-conical post of said heating unit.

18. The hair curling roller of claim 2 comprising a shell in the shape of a cage perforated by rectangular openings formed between several parallel circular hoops and several rows of parallel stays connecting each two adjoining hoops, the respective upper and lower end of said shell being in the shape of full, non-perforated cylinders, both hoops and end portions being provided with outwardly projecting teeth.

19. The hair curling roller of claim 1 wherein said cage is made of a synthetic resin, such as polypropylene.

20. The hair curling roller of claim 1 wherein said sleeve is made of aluminum alloy sheeting.

* * * * *